US008258975B2

(12) United States Patent
Tinnen et al.

(10) Patent No.: US 8,258,975 B2
(45) Date of Patent: Sep. 4, 2012

(54) COMMUNICATION SYSTEM FOR COMMUNICATION WITH AND REMOTE ACTIVATION OF DOWNHOLE TOOLS AND DEVICES USED IN ASSOCIATION WITH WELLS FOR PRODUCTION OF HYDROCARBONS

(75) Inventors: Bard Martin Tinnen, Stavanger (NO); Oivind Godager, Stavern (NO); Havar Sortveit, Hommersak (NO)

(73) Assignee: Well Technology, Stavanger (NO)

( * ) Notice: Subject to any disclaimer, the term of this patent is extended or adjusted under 35 U.S.C. 154(b) by 642 days.

(21) Appl. No.: 12/235,385

(22) Filed: Sep. 22, 2008

(65) Prior Publication Data

US 2009/0115624 A1 May 7, 2009

Related U.S. Application Data

(63) Continuation of application No. PCT/NO2007/000107, filed on Mar. 19, 2007.

(30) Foreign Application Priority Data

Mar. 20, 2006 (NO) ..... 20061275

(51) Int. Cl.
*G01V 3/00* (2006.01)

(52) U.S. Cl. ..... 340/853.6; 340/853.1; 340/854.3; 340/855.4; 367/81; 367/83; 181/102

(58) Field of Classification Search ..... 340/853.1, 340/853.6, 854.3, 854.9, 856.4, 855.4; 367/81–83, 367/85, 163, 166, 177, 178, 180, 189, 911; 181/101–122, 157; 73/151, 153; 310/311, 310/320, 322, 230

See application file for complete search history.

(56) References Cited

U.S. PATENT DOCUMENTS

| | | | | |
|---|---|---|---|---|
| 4,266,606 | A | 5/1981 | Stone | |
| 5,063,542 | A * | 11/1991 | Petermann et al. | 367/166 |
| 5,313,025 | A | 5/1994 | Roessler et al. | |
| 5,343,001 | A * | 8/1994 | Cowles et al. | 181/102 |
| 5,960,883 | A * | 10/1999 | Tubel et al. | 166/313 |
| 6,286,612 | B1 * | 9/2001 | Pascouet | 175/1 |
| 2004/0050555 | A1 | 3/2004 | Rayssiguier et al. | |
| 2004/0202047 | A1 * | 10/2004 | Fripp et al. | 367/81 |
| 2005/0022987 | A1 * | 2/2005 | Green et al. | 166/250.17 |

FOREIGN PATENT DOCUMENTS

EP 0485261 A1 5/1991

OTHER PUBLICATIONS

International Search Report for corresponding PCT Application No. PCT/NO2007/000107, mailed on Jun. 28, 2007.

* cited by examiner

*Primary Examiner* — George Bugg
*Assistant Examiner* — Franklin Balseca
(74) *Attorney, Agent, or Firm* — Knobbe Martens Olson & Bear LLP

(57) ABSTRACT

A system for communicating with downhole tools and devices is disclosed. The system includes multiple communication devices which, in combination, permit operators at the surface to operate downhole tools and to receive feedback regarding the state of the tools.

8 Claims, 12 Drawing Sheets

COMMUNICATION SYSTEM FOR COMMUNICATION WITH AND REMOTE ACTIVATION OF DOWNHOLE TOOLS AND DEVICES USED IN ASSOCIATION WITH WELLS FOR PRODUCTION OF HYDROCARBONS

RELATED APPLICATIONS

This application is a continuation of PCT/NO2007/000107, filed Mar. 19, 2007, which was published in English and designated the U.S., and claims priority to NO 20061275 filed Mar. 20, 2006, each of which are included herein by reference.

BACKGROUND OF THE INVENTION

1. Field

The field relates to a system and a method for remote activation of downhole tools and devices used in association with wells for the production of hydrocarbons.

2. Description of Related Technology

Oil- and gas producing wells are designed in a range of different ways, depending on factors such as production characteristics, safety, installation issues and requirements to downhole monitoring and control. Common well components include production tubing, packers, valves, monitoring devices and control devices.

An extremely important consideration for all design and operations is to maintain a minimum number of barriers (e.g. 2) between the high-pressurised reservoir fluids and the open environment at the surface of the earth. Packers and valves are examples of commonly used mechanical barriers. Other barriers can be drilling mud and completion fluid which create a hydrostatic pressure large enough to overcome the reservoir pressure, hence preventing reservoir fluids from being produced.

Following the drilling stage; the installation of the production tubular, including a selection of the above described components and the wellhead is referred to as completing the well. During completion, temporary barriers are used to ensure that barrier requirements are adhered to during this intermediate stage. Such temporary barriers could be, for example, intervention plugs and/or disappearing plugs mounted in the lower end of the production tubing or the higher end of the well's liner.

Intervention plugs are typically installed and retrieved with well service operations such as wireline and coil tubing. Disappearing plugs are temporary barrier devices that are operated with pressure cycling from surface, i.e. surface pressure cycles are applied on the fluid column of the well to operate pistons located in the downhole device (disappearing plug). After a certain amount of cycles, the disappearing plug opens (i.e. "disappears"), hence the barrier is removed according to the well completion program.

Evolution of oil wells has included well designs such as multi lateral wells and side-tracks. A multilateral well is a well with several "branches" in the form of drilled bores that branch from the main bore. Multilateral wells allow a large reservoir area to be drained with one primary bore from the surface. A side track well is typically associated with an older production well that is used as the foundation for the drilling of one or more new bores. Hence, only the bottom section of the new producing interval needs to be drilled and time and costs are saved.

To sidetrack a well, the following operational method may be used:

One starts by installing a deep-set barrier in the wellbore, above the top of the old producing interval and below the kick-off point for the new branch to be drilled.

A whipstock is installed—this is a wedge shaped tool utilised to force the drill bit into the wall of the wellbore and into the formation.

The branch is drilled.

The branch is completed with the preferred selection of completion components.

The temporary barrier in the original bore is removed, if possible.

The well is put on production, producing from both the new and the old bore.

The new well designs (i.e. branches) have introduced a new challenge in the form of inaccessible areas of the well. Traditional operation of the above described temporary barrier systems may no longer be possible. Well intervention strings are normally not operated below junctions of branch wells, as the risk of getting stuck or causing other types of damage is considered too high. Also, in a branch well, one does not normally manage to seal off all rock faces, hence pressure cycling to operate traditional disappearing plugs might not be possible as the exposed rock may prevent the generation of pressure cycles of the required amplitude. Accordingly, the internal piston (or bellows or other similar mechanism) arrangements of the disappearing plugs cannot be operated.

In addition, certain specific completion methodologies for the new branch of a sidetrack well, for example if the branch's liner top is attached to the original well bore, or the whipstock being left in the well after sidetracking, will make the old producing interval totally non-accessible. Again, this will represent challenges with respect to the removal of traditional, temporary deep-set barriers.

SUMMARY OF CERTAIN INVENTIVE ASPECTS

One aspect provides a novel and alternative system for remote activation of downhole tools and devices associated with wells for the production of hydrocarbons. One embodiment will enable operation, activation and/or removal of components located in inaccessible areas of wells such as branch wells and sidetracks.

BRIEF DESCRIPTION OF THE DRAWINGS

The invention will now be described in more detail by means of the accompanying figures.

DETAILED DESCRIPTION OF THE INVENTION

Figure 1:
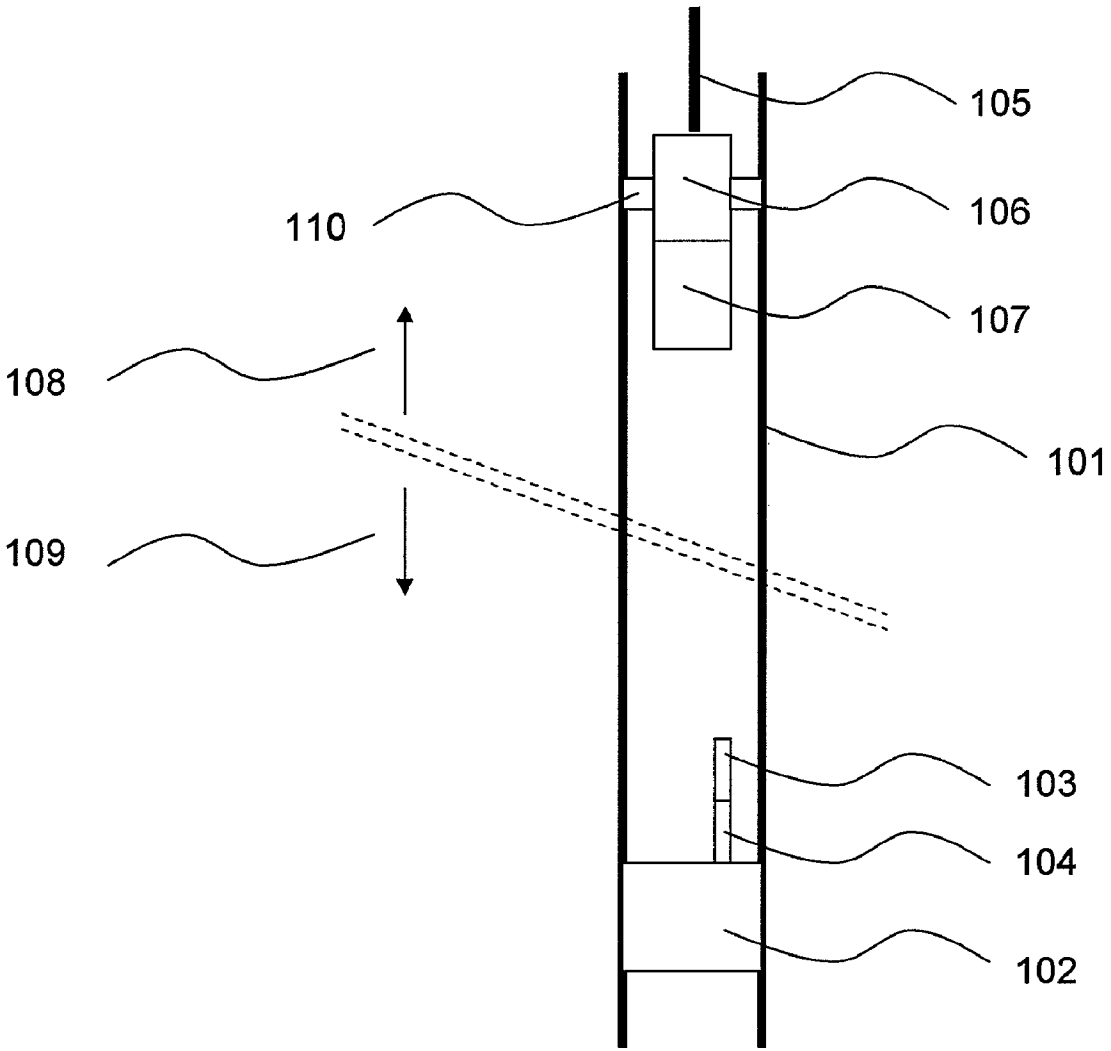
FIGS. 1-4 illustrates various embodiments of the invention.

One method for activation/removal of temporary barriers in sidetrack wells, is to utilise deep set barriers in the form of glass plugs equipped with a timer that detonates an explosive charge and removes the plug after a predetermined time. In this way, the barrier element acts as an autonomous device operating according to its own pre-programmed logic. Because it is autonomous, the system could be installed in inaccessible regions of a well and still work satisfactorily. The drawback with this method is that the memory has to be pre-programmed at the surface, prior to installing the deep-set barrier in the well. Because of that, the following has to be taken into consideration: The deep-set barrier is not removed before the sidetracking operation is finished. Hence, a margin has to be included in the programming. For example, if a sidetrack operation is estimated to take 20 days, the timer arrangement might be programmed to remove the deep-set barrier after 40 or 60 days. Hence, one risks losing a significant amount of production time because the original well bore remains closed for a long time after the side track operation is completed. Also, if the drilling and completion is conducted from a floating drilling rig, the rig will normally be moved off location once the completion is finished. The delay in removing the last barrier means, that should the timer method fail to operate, there will not be any rig on the site to perform any remedial work. Hence, substantial time and production might be lost awaiting a new rig to be available for the removal of the last barrier.

Pressure cycling can be used to remotely activate disappearing plugs and other well components from surface. The principle involves using a pump on the surface to pressurize the well (completion) fluid repeatedly according to certain protocols. The pressure cycles are transmitted across the fluid column and an equal increase in pressure downhole operates piston- bellows- or similar arrangements which again are linked to an activation mechanism. Such systems use a minimum amount of differential pressure across the piston-, bellows- or similar arrangement to operate the mechanism. For many new well scenarios, including sidetracks and multilaterals, parts of the wells rock face could be exposed. Hence, when trying to cycle pressure, fluid escaping into the exposed rock could prevent the required downhole pressure increases to take place. Hence, the method becomes unreliable and non-feasible for some types of well scenarios.

There also exists numerous ways to use wireless signalling to remotely activate downhole components. U.S. Pat. No. 6,384,738 B1 describes the use of a surface air-gun system to communicate through a partly compressible fluid column. In a somewhat similar manner, the "EDGE" system (trademark of Baker Hughes) uses a surface signal generator to inject pulses of chosen frequency into the wellbore. With regards to this system, a downhole tool, for instance a packer, is equipped with a signal receiver which again interfaces towards a controller system. When the surface-transmitted signal is received downhole, it is interpreted and used to generate the action of intent, for example the setting of the packer.

When sidetracking a well, the section between the temporary barrier and the kick off point for the branch normally becomes filled with cuttings from the drilling process plus settling particles (barite) from the drilling mud. This will potentially have a very negative effect on wireless acoustic signals transmitted in the fluid column. In addition, certain completion methods may create geometrical patterns of the continuous liquid column that could cause additional damping and scattering effects. Examples of this are perforated whipstocks that will contain only small conduits and a geometrical pattern of flow as well as acoustic waves that will differ substantially from the general tubing profile.

The airgun system related to U.S. Pat. No. 6,384,738 B1 intended to work with a compressible fluid in the top of the well column and an incompressible bottom section, could be non-suitable for the activation of a deep set barrier after a sidetrack drilling operation, as the signal will get dampened along the wellbore, and the additional, last part of the path comprising cuttings, barite and irregular geometry may dampen the signal significantly, below a detectable level for the receiver. The same applies for the EDGE system (trademark of Baker Hughes).

Also, when activating a component in a sidetrack or multilateral well, with exposed rock faces, it can be very difficult to verify that the desired downhole operation actually has taken place by monitoring surface parameters such as pressure or flow. None of the above described methods are equipped with relevant monitoring features enabling feedback to the surface on the performance of the downhole operation. A more accurate and reliable feedback system is required.

Certain embodiments include bringing a wireless signal transmitter into the well, to a close proximity of the receiver, in order to overcome excessive dampening effects related to cuttings/barite fill and complex fluid column geometries. Also, some embodiments include a reliable feedback system to verify operational success.

In some embodiments, a signal transmitter and a signal receiver system, are located in a position higher and lower in the well, respectively. The receiver is associated with a downhole device of interest, for example a temporary barrier element. Another embodiment includes a signal transmitter and a signal receiver system, located in a position lower and higher in the well, respectively. Another embodiment includes a combination of signal transmitter(s) and receiver(s) at two or several locations in the well.

In some embodiments, the transmitter is in the form of a well intervention tool that is run into the well by means of a well service technique such as wireline or coil tubing. This enables the transmitter to be brought to a close proximity to the downhole receiver. The transmitter can be built as a standalone module or interface towards a $3^{rd}$ party well intervention tool, such as a wireline tractor.

In one embodiment, the transmitter is located at the surface, on or in the proximity of the wellhead.

In yet another embodiment, the transmitter is associated with a downhole device, to transmit downhole information to a signal receiver placed higher in the well. This could be a downhole data acquisition device that, on a frequent basis, uploads data to a receiver located at a higher point in the well, either on the surface or in the form of a downhole tool, lowered into the wellbore to a close proximity to the transmitter. The latter case would entail a larger bandwidth of the data transfer.

In some embodiments, both the modules (located higher and lower in the well) can transmit and receive signals, i.e. function as transceivers. The upper and lower transceiver represent a two way communication system that for example can be used to remotely activate a downhole device whereupon information is sent from the lower system to the higher system to verify the execution of a desired operation.

In some embodiments, the receiver is associated with an activation system, so that the main receiver function is to read and interpret the activation signal from the transmitter, whereupon a subsequent activation command is sent from the receiver to the activation system in order to do work on the downhole component, for example the removal of a deep-set barrier after a sidetrack operation is completed. In one embodiment, the activation system is part of the overall system. In another embodiment, the receiver is built into a module of its own that interfaces towards a $3^{rd}$ party activation system.

Common applications would be the activation of downhole well components that are located in such position that they are non-accessible and/or non-feasible for well intervention toolstrings as well as existing techniques for remote activation.

Figure 2:
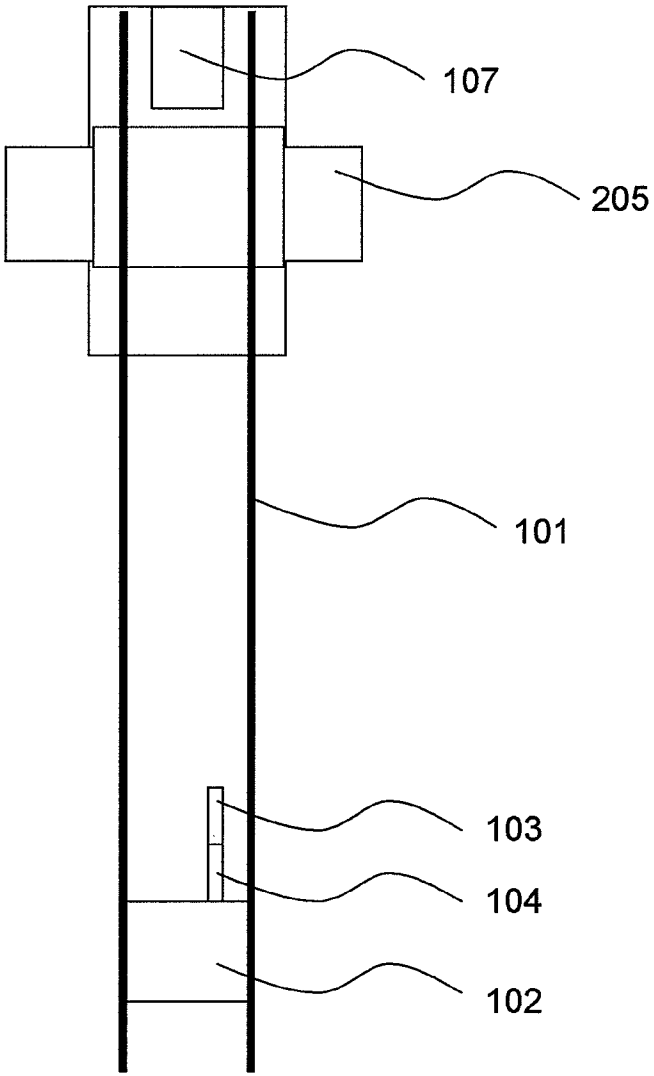

FIG. 1 illustrates an overall system description for an embodiment of a plug, a valve or other types of downhole devices. The downhole device is associated with a signal receiver 103 and an activation system 104. A wireline 105 and associated toolstring 106 is used to deploy a signal transmitter 107 into the well 101. The set of dotted lines shows that the well comprises a well section that is available for intervention 108 and a well section that is non-available for intervention 109. The toolstring 106 may be equipped with a wellbore anchor 110. The anchor 110 may be used to assure stability of the transmitter 107 during operation in order to impose an optimum signal into the primary signalling medium (the well fluid) and/or a secondary/complementary signalling medium (the steel tubing of the well 101). The transmitter 107 may be designed for producing a signal with sufficient strength to overcome obstacles related to solids and/or liquids as well as well geometries with poor acoustic properties FIG. 2 illustrates a system of another embodiment. A wellbore 101 includes a downhole device 102. For this embodiment, a signal transmitter 107 is placed in or near a wellhead 205 in connection with the well 101.

Figure 3:
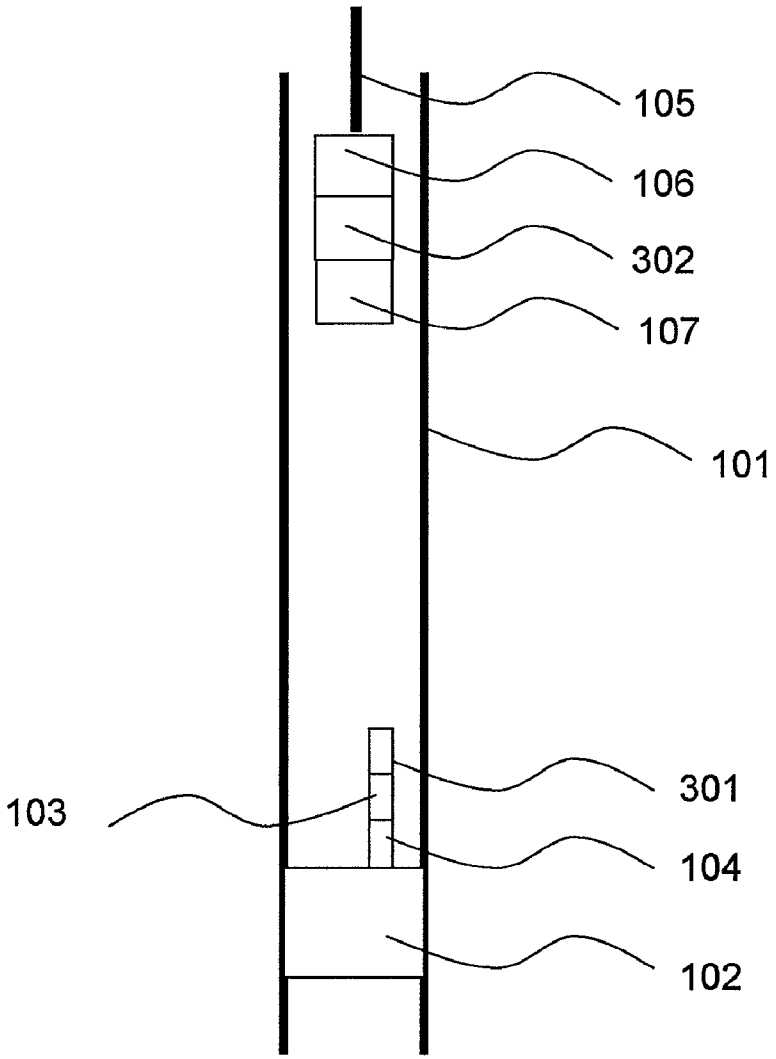

FIG. 3 illustrates yet another embodiment. A wellbore 101 includes a downhole device 102. The downhole device is associated with a signal receiver 103, an activation system 104, and a signal transmitter 301. A wireline 105 and associated toolstring 106 is used to deploy a tool comprising signal transmitter 107 and signal receiver 302 into the well 101. This configuration enables two way communication which, as an example, will enable a confirmation-of-execution signal to be sent from the downhole transmitter 301 to be received by the receiver 302 after activation of the downhole device 102. In one embodiment, the receiver 302 may be associated with sensor systems monitoring parameters such as wellbore noise patterns resulting from the activation of the downhole device 102.

Figure 4:
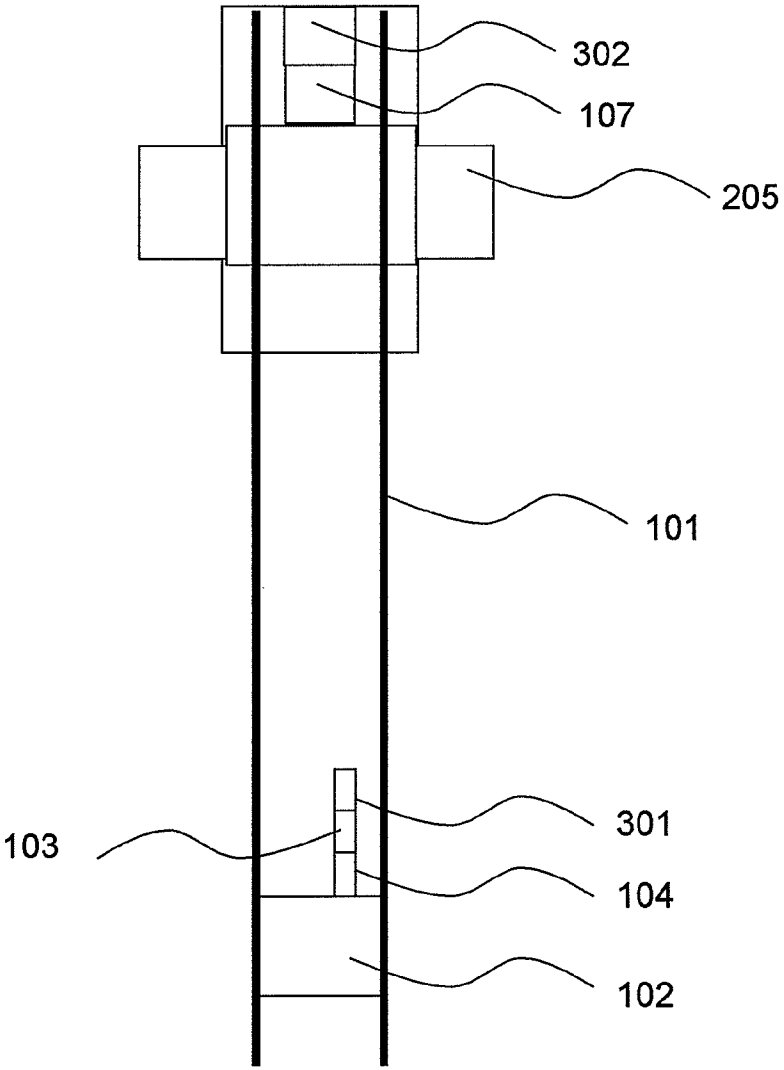

FIG. 4 illustrates yet another embodiment. A wellbore 101 includes a downhole device 102. The downhole device 102 is associated with a signal receiver 103, an activation system 104, and a signal transmitter 301. A signal transmitter 107 and a signal receiver 302 are placed in or near a wellhead 205 in connection with the well 101.

Figure 5:
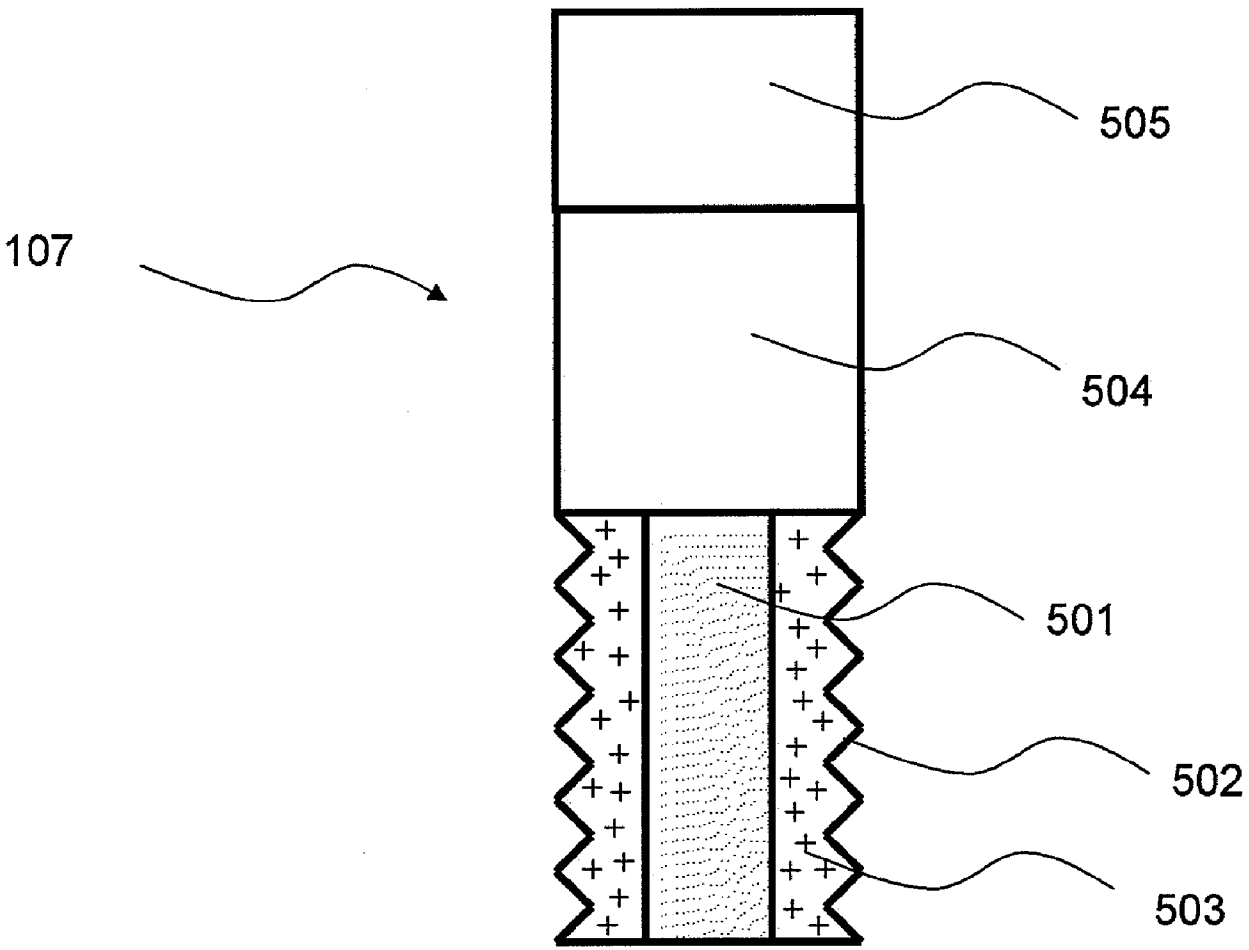
FIGS. 5-11 illustrates possible ways of designing the transmitter and/or the receiver in more detail.

FIG. 5 illustrates a transmitter 107. The transmitter 107 comprises an actuator 501 that is attached to a flexible membrane 502 filled with a fluid 503. Also, the transmitter 107 in this example comprises an electronic module 504 and an interface toward a 3$^{rd}$ party wireline tool 505. Through the electrical cable 105 of FIG. 1, a command is transmitted from the surface to the electronic module 504. Further, the command is transferred to the actuator 501, which is put into oscillations. Typically, the actuator 501 is a sonic actuator made of piezo-electric wafers or a magnetostrictive material such as Terfenol-D. When the actuator 501 is put into oscillations, these oscillations are transferred to the well fluid by the membrane 502. The membrane fluid 503 prevents the membrane from collapsing in the high pressurised well environment. Also, an anchor 110 (shown in FIG. 1) might be used to optimize the process of transferring the signal into the primary signalling medium (the well fluid) as well as enable the possibility for using a secondary, supplementary signalling medium (the steel tubing). The basic principles of FIG. 5 may also apply for the transmitter 301 of FIGS. 3 and 4.

Figure 6:
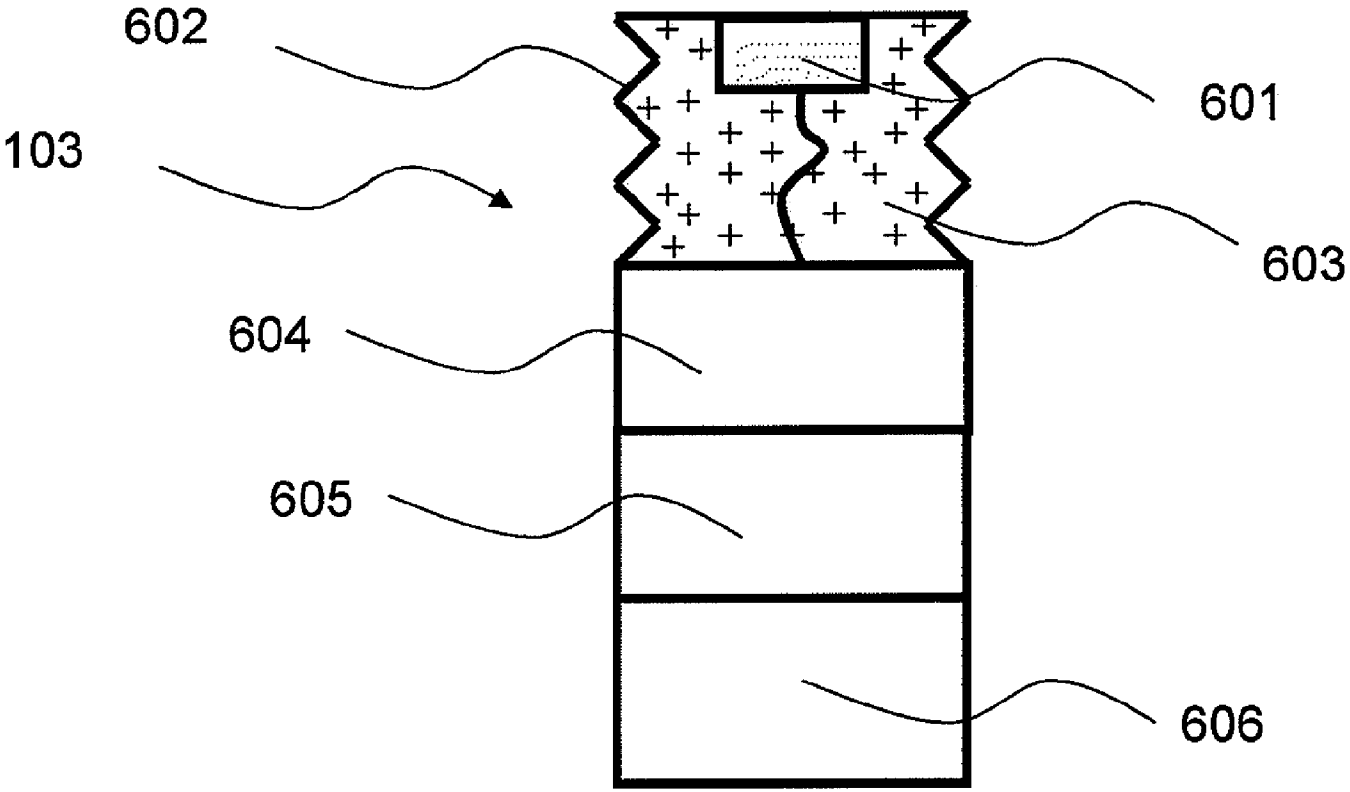

FIG. 6 illustrates an embodiment of receiver 103 of FIG. 1. Receiver 103 may be associated with a transmitter 107 as illustrated in FIG. 5. The receiver 103 includes a vibration sensor 601 that is fixed to a flexible membrane 602 filled with a fluid 603. Vibration sensor 601 may be, for example, a piezoelectric disc, an accelerometer, or a magnetostrictive material. The receiver 103 also comprises an electronic section 604, a battery section 605 and an activation module 606. A signal from the transmitter 107 of FIG. 5 is transmitted through the well fluid and/or the walls of the completion tubing in the form of acoustic waves. Typically, for the operations of interest, the well 101 is filled with a stagnant completion fluid, for example brine. The signal makes the membrane 602 of the receiver 103 oscillate, and this oscillation is registered by the vibration sensor 601. The sensor is read by the electronic module 604 where the information/signal is decoded. If the code overlaps with the activation code for the relevant downhole device of interest, an activation signal is transferred to the activation module 606, whereupon tool activation is executed. As the receiver 103 is located in a section of the well where there is no transfer of power from surface, the receiver 103 is powered by the batteries of the battery module 605. The basic principles of FIG. 6 may also apply for the receiver 302 of FIGS. 3 and 4.

Figure 7:
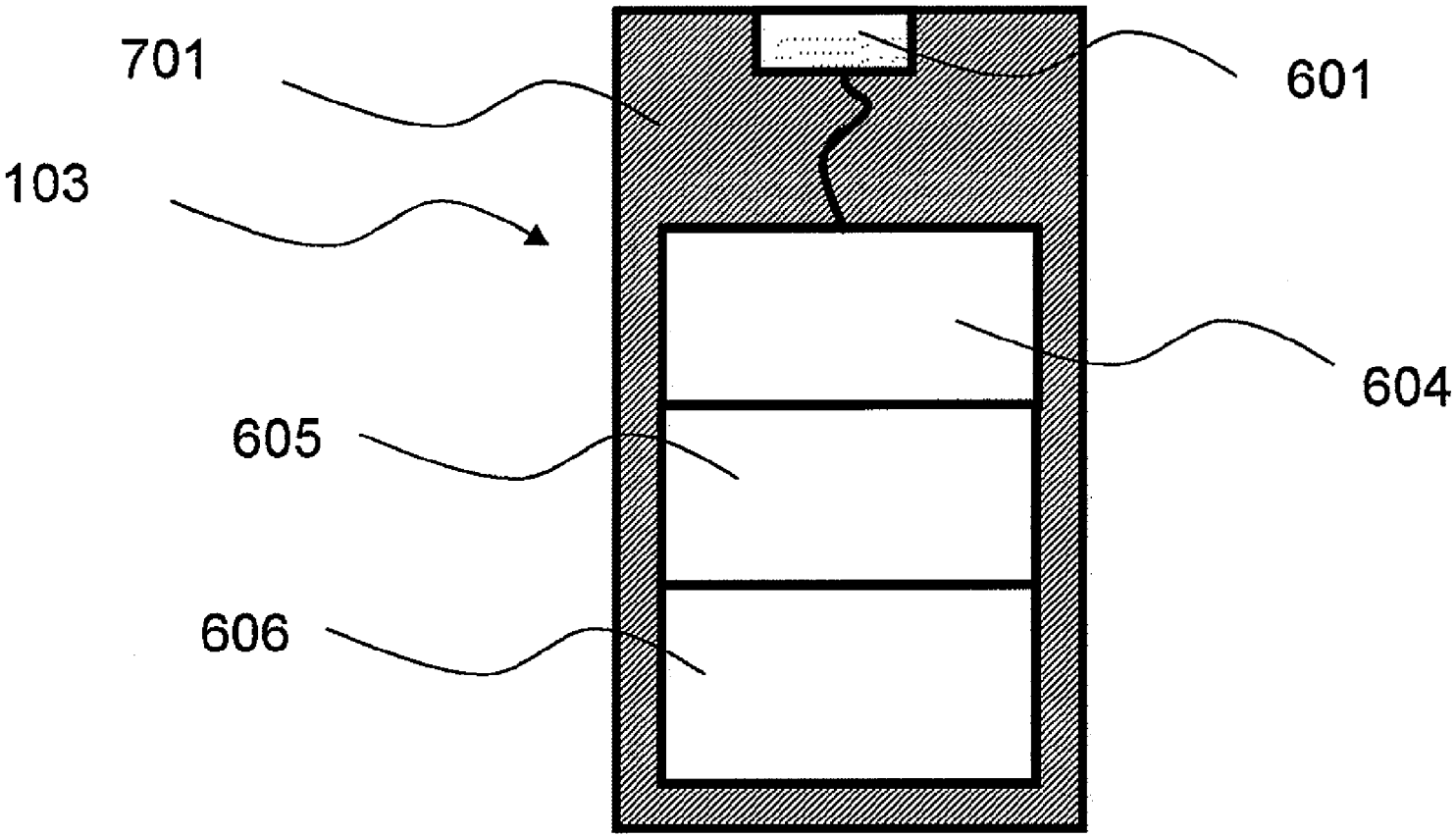

FIG. 7 illustrates another receiver 103 of FIG. 1. For this embodiment, the receiver 103 comprises a vibration sensor 601 that is fixed to the body 701 of receiver 103. The basic principles of FIG. 7 may also apply for the receiver 302 of FIGS. 3 and 4.

Figure 8:
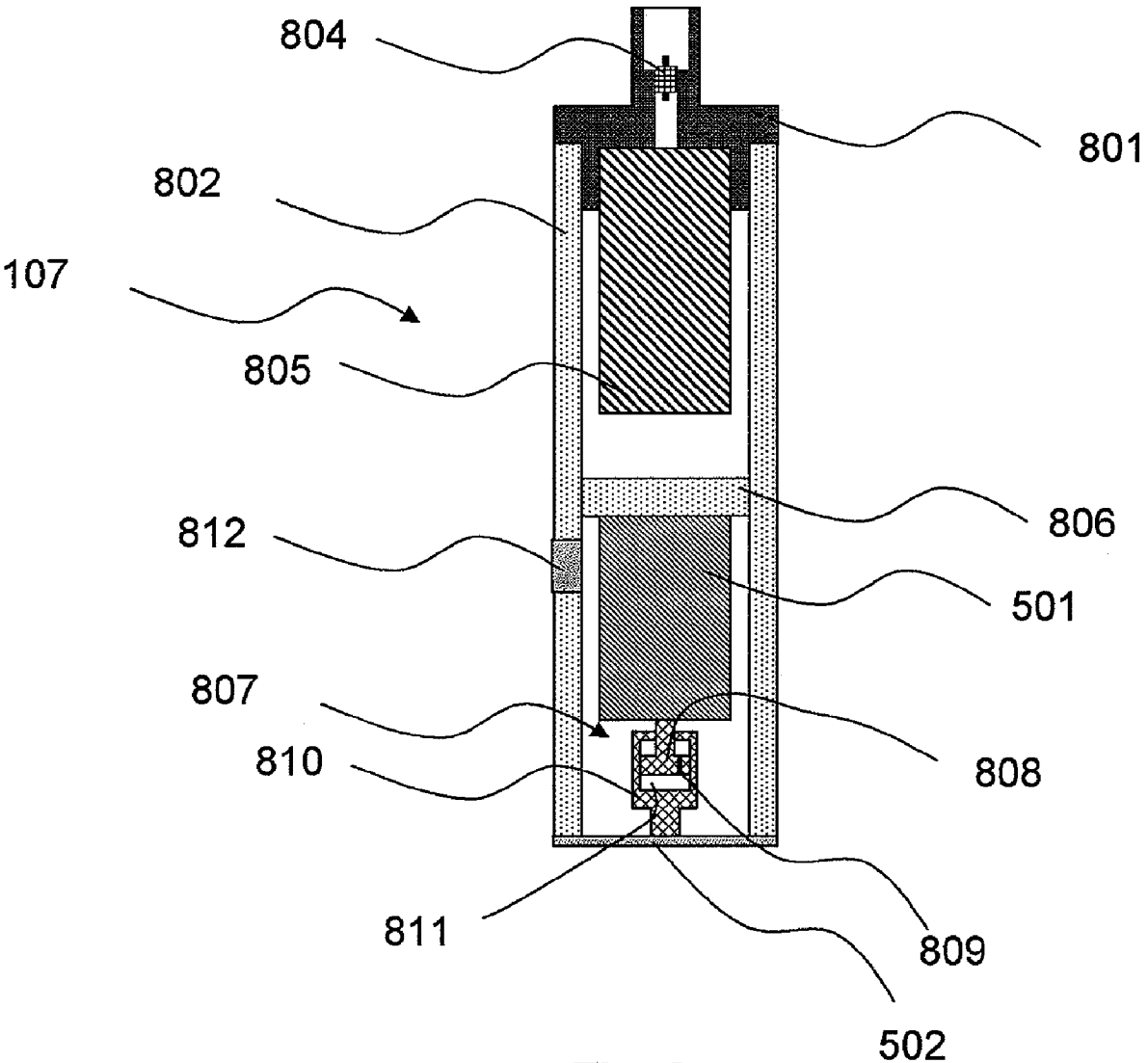

FIG. 8 illustrates an embodiment of the transmitter 107 of FIG. 1 in more detail. The transmitter body comprises a connector 801, a housing 802, and a flexible membrane 502. The connector 801 provides a mechanical and electrical connection towards a standard wireline tool string (ref 106 of FIG. 1). An electrical feedthrough 804 provides an electrical connection to the wireline toolstring and from thereon to operator panels on the surface. The tool comprises an electronic circuit board 805, a connection flange 806, an actuator 501, and a coupler device 807 to compensate for deflections of the membrane 502 as the tool is lowered into the highly pressurised well regime. Operator commands are transferred from surface via the wireline cable (ref 105 of FIG. 1) to the electronic circuit board 805. The commands are processed in the electronics circuit board 805, and a signal is sent to the actuator 501 which is put into oscillations as defined by said signal. One end of the actuator 501 is fixed to the tool housing 802 via a connection flange 806 within the tool body. The oscillations are transferred to the flexible membrane 502 via the coupler 807.

The coupler 807 may be any kind of arrangement that allows for pressure imposed deflection of the membrane 502 without creating excessive stresses in the actuator 501 and still being able to transfer oscillations from the actuator 501 to the membrane 502.

In one embodiment, the coupler 807 is a hydraulic device, which comprises a piston 808 with a micro orifice 809, and a cylinder 810 filled with hydraulic oil 811. The oscillations are transferred from the actuator 501 into the piston 808, which will put oscillating forces into the hydraulic oil 811, which in turn will transfer said oscillations into the cylinder body 810, which in turn will transfer the oscillations into the flexible membrane 502, which in turn will transfer said oscillations into the wellbore fluid and/or the completion components, which in turn will transfer said oscillations to the signal receiver (ref 103 of FIG. 1).

The micro orifice 809 is made sufficiently small to not allow for rapid fluid flow, such that the oscillating forces will be transferred to the membrane 502 according to the orifice 809. By the same token, the micro orifice 809 will allow for sufficient fluid flow to match the relatively slow deflection movement of the membrane 502 as a function of submerging the tool into the well (i.e. increasing the surrounding pressure). Hence, the micro orifice 809 functions as a pressure compensator for the system as the transmitter 107 is placed into a well. This enables the actuator 501 to function under atmospheric conditions regardless of exterior well pressure, which is advantageous, as no hydrostatic pressure related stresses, direct as well as indirect, will be imposed onto the actuator material. As exterior well pressure increases, the micro orifice 809 will allow oil to be transferred across the piston such that exterior pressure will not apply forces to the piston 808 and hence to the actuator 501.

A sensor 812 attached to the housing 802 is included to monitor the sonic/vibration in the well or other relevant parameters. The information sensed is transferred to the electronics circuit board 805 where it is processed and transferred to surface via the wireline cable 105. The information will supply the surface operator with information related to both transmitter operation and other parameters (for instance vibration or noise pattern) resulting from the activation of a said downhole device. The sensor 812 forms a part of the receiver 302 described in FIG. 3.

Figure 9:
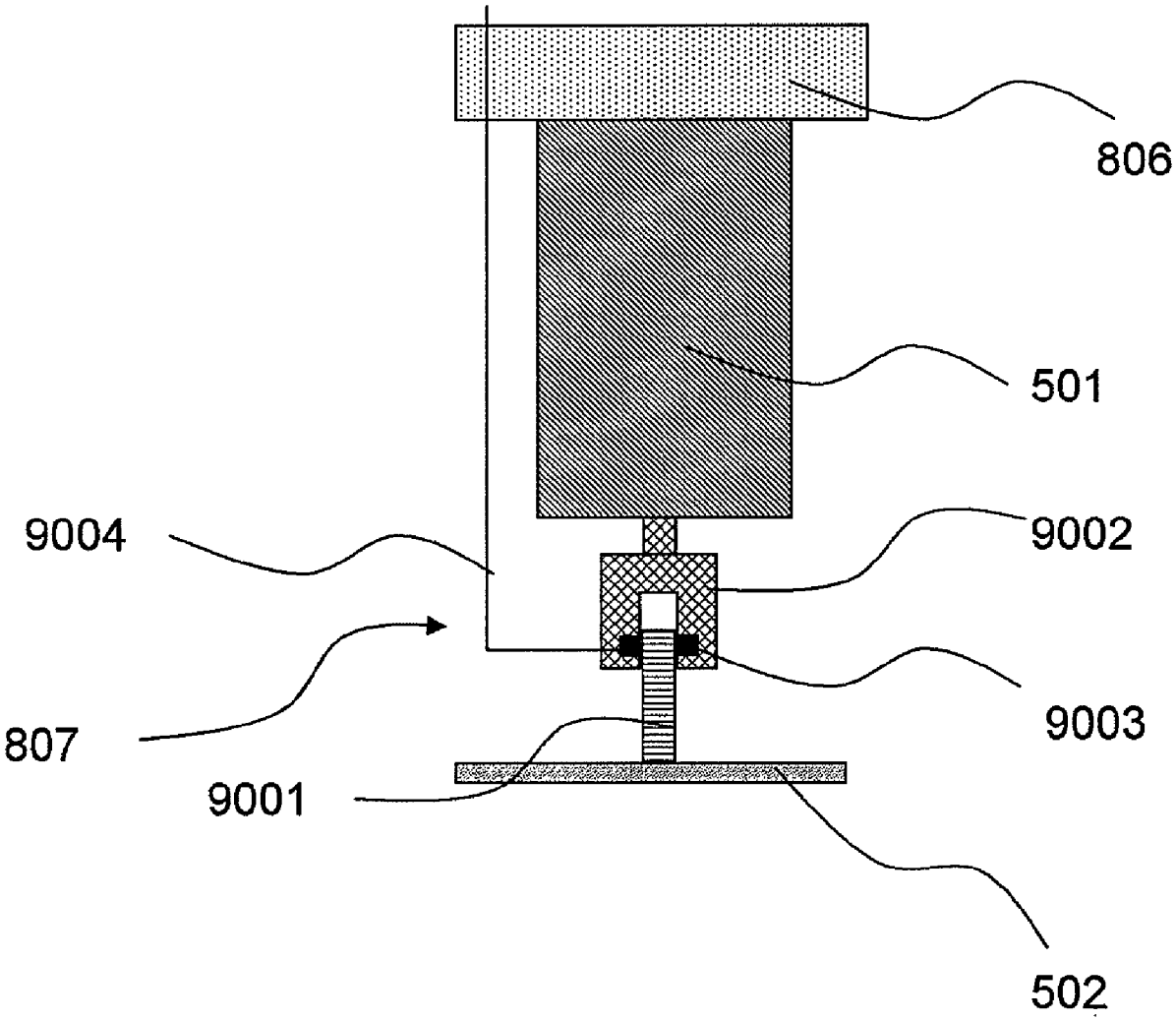

FIG. 9 illustrates an alternative embodiment of the coupler 807. A shaft 9001, is attached to the flexible membrane 502, is mounted to slide along its main axis inside the bore of an engagement sub 9002. During the part of an operation where the transmitter 107 is lowered into the well 101, the shaft 9001 is free to move longitudinally inside the bore of the engagement sub 9002. As the external pressure increases and the flexible membrane deflects due to this, the shaft 9001 slides further into the bore of the engagement sub 9002. Upon the time of signalling, an engagement system 9003 is engaged in order to lock the shaft 9001 inside the engagement sub 9002. A solid connection is then formed between the actuator 501 and the flexible membrane 502. In order to engage the engagement system 9003, various methods may be utilised. One example of such is a motor driven engagement system powered by one or more electric line(s) 9004 that comes from the system electronics. In one embodiment, the engagement sub 9002 also pre-tensions the membrane 502 with respect to the actuator 501 in order to generate prepare the oscillation system.

Figure 10:
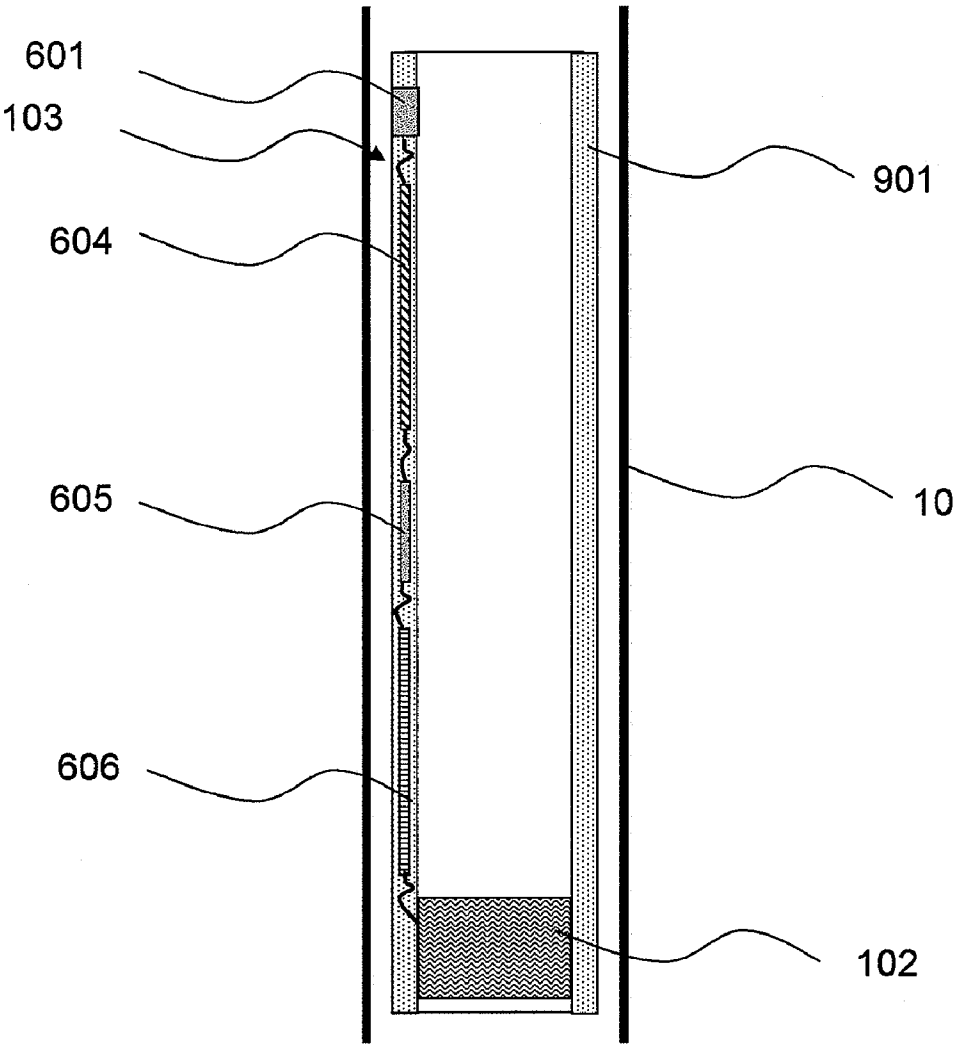

FIG. 10 illustrates one embodiment of the receiver 103 of FIG. 1 in more detail. This receiver 103 may be associated with a transmitter 107 as illustrated in FIG. 8. The receiver 103 includes a vibration sensor 601, an electronic circuit board 604, and a battery pack 605, which are all placed inside the wall of a tubing 901. The tubing 901 may have the same physical shape as other completion and/or intervention equipment in the well 101, such that the whole system can be integrated into a downhole assembly. Such downhole assembly can be any downhole completion and/or intervention device equipped with an activation system. A unique signal is transferred via the wellbore fluid and/or completion components, as explained for FIG. 5 above. This signal is picked up by the vibration sensor 601 and processed by the electronic circuit board 604. The electronic circuit board will transmit another signal to the activation module 606 of the downhole device 102 whereupon the desired operation is executed. The activation module 606 can be integrated into the wall of tubing 901 or can be built into a $3^{rd}$ party supplied device.

Figure 11:
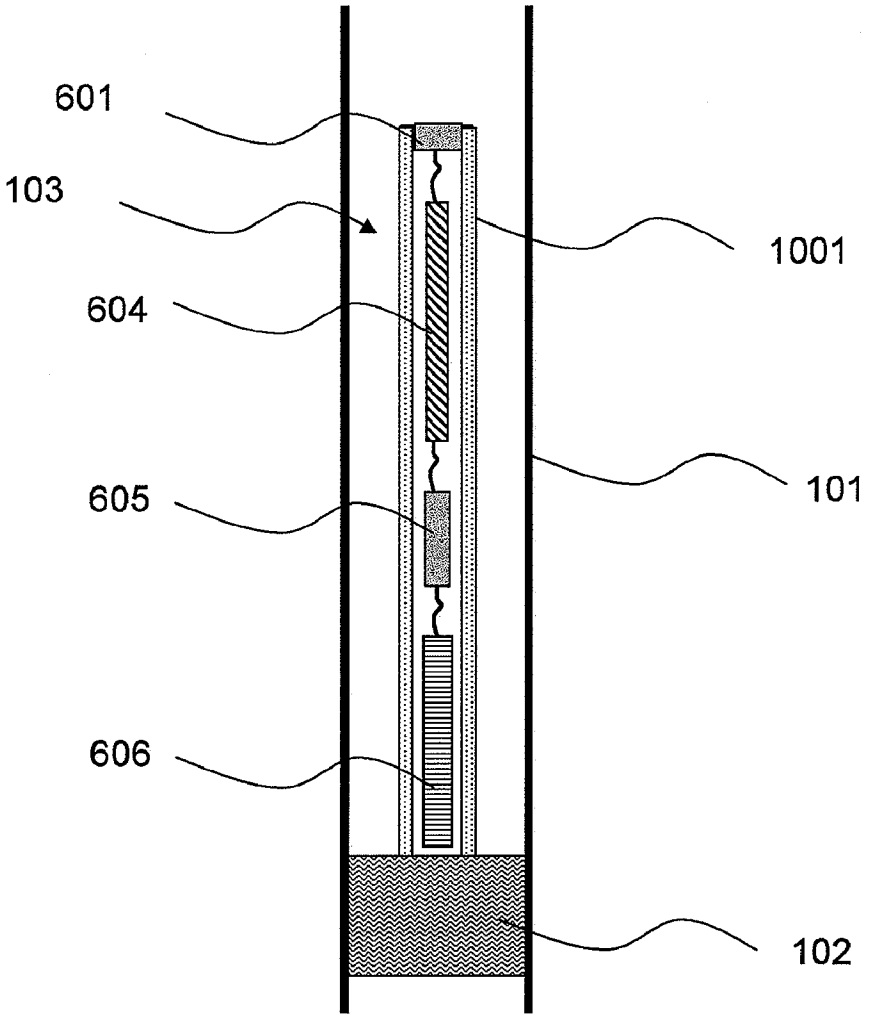

FIG. 11 illustrates another receiver 103 of FIG. 1 in more detail. Receiver 103 of FIG. 11 is in general the same as that presented in FIG. 9, but here all system components are placed inside a tube 1001 of a relatively small outer diameter. This tubing 1001 may be made to be attached to a downhole device 102.

Figure 12:
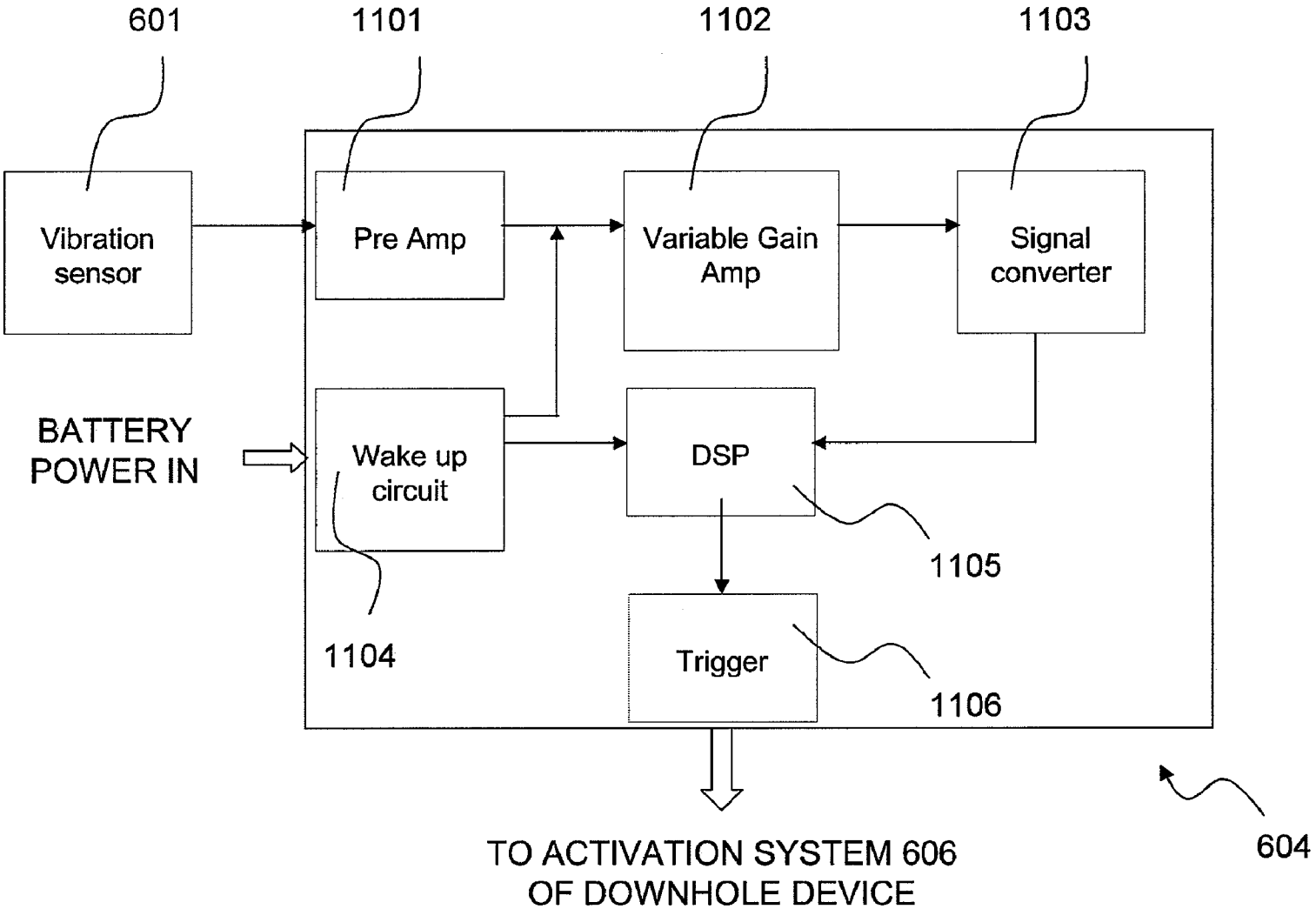
FIG. 12 illustrates one possible way of designing the receiver electronic package.

FIG. 12 illustrates one embodiment of the electronics module 604 of receiver 103 of FIGS. 1, 10 and 11. The electronics module 604 may be associated with an activation module 606 as described in FIG. 6. A signal transmitted from the signal transmitter 107 of FIG. 8 through the wellbore fluid and/or the completion components impart stresses and tension onto the vibration sensor 601 resulting in an electrical signal. The electrical signal is amplified by the pre amp 1101, and the variable gain amp 1102, and converted into a digital signal by the signal converter 1103.

The digital signal from the signal converter 1103 is processed by the digital signal processor 1105, and if the received signal is according to a preprogrammed protocol, the digital signal processor 1105 sends an activation signal to activate the trigger mechanism 1106, which in turn allows the activation signal to be transmitted to the activation system of the downhole device. The trigger mechanism 1106 includes a safety function which provides a circuit breaker point (for instance an inductive coupling) between the receiver electronics module 604 and any activation system 606 to be activated. The circuit breaker prevents accidental activation of the downhole device due to stray currents or other accidental bypasses of the activation system. In one embodiment, the signal is defined by FSK (Frequency Shift Key) coding. This eliminates possibilities for the wireless signal to be produced by noise that could be present in the well 101 (for instance during drilling), leading to accidental, premature activation of the downhole device.

The complete system may, as default, be kept in an idle mode to save energy (battery) while awaiting the activation signal. The full operation of the circuitry may be initiated by recognition of a predetermined signal registered by the wake up circuit 1104 (i.e. the signalling operation may be initiated by a wake up signal).

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A communication system for communicating signals within a hydrocarbon well, the system comprising:

at least one first communication device located in a first portion of a wellbore of the well, the first communication device comprising at least one of a signal transmitter and a signal transceiver; and at least one second communication device located in a second portion of the wellbore, the second communication device comprising at least one of a signal receiver and a signal transceiver, wherein at least one of the first and second communication devices is associated with an activation system for a downhole device located in the wellbore, wherein the first communication device further comprises:

a connector linking the first communication device to surface located equipment;

a housing;

a flexible membrane;

an actuator comprising one of piezo-electric wafers or a magnetostrictive material; and a coupler device, wherein the coupler device transfers oscillations from the actuator to the membrane by a coupling liquid or by an engagement sub connected to the actuator and a shaft attached to the membrane, wherein the sub lockingly engages the shaft in a signaling mode and slidably engages the shaft in a non-signaling mode, wherein the flexible membrane is configured to transfer oscillations to a wellbore fluid and thereby to a receiver in the second communication device located at a lower position in the wellbore, wherein the coupler device comprises a piston device having a piston shaft connected to the actuator and a piston engaging the coupling fluid to act on the membrane via the coupling fluid, the piston comprising a micro-orifice extending through the piston to enable controlled deflection of the membrane.

2. The system of claim 1, wherein the first communication device is incorporated in a well intervention tool.

3. The communication system of claim 1, wherein the transmitter of the first communication device comprises an anchoring device for engagement with the wall of the wellbore.

4. The communication system of claim 1, wherein the transceiver of the first communication device comprises a receiver comprising a vibration sensor fixed to a flexible membrane filled with a fluid, wherein the vibration sensor is selectable from one of: a piezoelectric disc, an accelerometer, and a magnetostrictive material.

5. The communication system of claim 1, wherein the transceiver of the first communication device comprises a receiver comprising a vibration sensor fixed to a body of the receiver, wherein the vibration sensor is selectable from one of: a piezoelectric disc, an accelerometer, and a magnetostrictive material.

6. The communication system of claim 1, wherein the receiver or the receiver of the transceiver in the second communication device comprises a vibration sensor fixed to a flexible membrane filled with a fluid, wherein the vibration sensor is selectable from one of: a piezoelectric disc, an accelerometer, and a magnetostrictive material.

7. The communication system of claim 1, wherein the receiver or the receiver of the transceiver in the second communication device comprises a vibration sensor fixed to a body of the receiver, wherein the vibration sensor is selectable from one of: a piezoelectric disc, an accelerometer, and a magnetostrictive material.

8. The communication system of claim 1, wherein the second communication device comprises electronics, a battery, and an activation module for activation of a downhole tool.

* * * * *